US007086615B2

(12) United States Patent
Joseph

(10) Patent No.: US 7,086,615 B2
(45) Date of Patent: Aug. 8, 2006

(54) FUEL INJECTOR INCLUDING AN ORIFICE DISC AND A METHOD OF FORMING AN OBLIQUE SPIRAL FUEL FLOW

(75) Inventor: J. Michael Joseph, Newport News, VA (US)

(73) Assignee: Siemens VDO Automotive Corporation, Auburn Hills, MI (US)

( * ) Notice: Subject to any disclaimer, the term of this patent is extended or adjusted under 35 U.S.C. 154(b) by 239 days.

(21) Appl. No.: 10/848,078

(22) Filed: May 19, 2004

(65) Prior Publication Data

US 2005/0258277 A1 Nov. 24, 2005

(51) Int. Cl.
*B05B 1/00* (2006.01)

(52) U.S. Cl. ..... 239/596; 239/533.2; 239/533.12; 239/601; 239/585.1; 239/585.4; 239/585.5; 239/900

(58) Field of Classification Search ..... 239/533.12, 239/463, 596, 597, 599, 601, 533.2, 585.1, 239/585.3, 585.4, 585.5, 900
See application file for complete search history.

(56) References Cited

U.S. PATENT DOCUMENTS

| | | | |
|---|---|---|---|
| 335,334 | A | 2/1886 | Brady |
| 600,687 | A | 3/1898 | Flemming |
| 1,801,153 | A | 4/1931 | Gray |
| 1,801,453 | A | 4/1931 | Patterson |
| 2,737,831 | A | 3/1956 | Webb |
| 2,846,901 | A | 8/1958 | Baule |
| 2,846,902 | A | 8/1958 | Cowley |
| 3,656,379 | A | 4/1972 | Clark |
| 3,678,941 | A | 7/1972 | Dixon |
| 3,978,705 | A | 9/1976 | Pearce et al. |
| 4,057,190 | A | 11/1977 | Kiwior et al. |
| 4,072,039 | A | 2/1978 | Nakanishi |
| 4,101,074 | A | 7/1978 | Kiwior |
| 4,437,612 | A | 3/1984 | Russ et al. |
| 4,513,914 | A | 4/1985 | Cook |
| 4,532,906 | A | 8/1985 | Höppel |
| 4,621,772 | A | 11/1986 | Blythe et al. |
| 4,771,663 | A | 9/1988 | Naito et al. |
| 4,923,169 | A | 5/1990 | Grieb et al. |
| 4,925,111 | A | 5/1990 | Foertsch et al. |
| 4,970,926 | A | 11/1990 | Ghajar et al. |
| 5,002,231 | A | 3/1991 | Reiter et al. |
| 5,038,738 | A | 8/1991 | Hafner et al. |

(Continued)

FOREIGN PATENT DOCUMENTS

| | | | |
|---|---|---|---|
| EP | 1 092 865 | A | 4/2001 |

(Continued)

*Primary Examiner*—Dinh Q. Nguyen

(57) ABSTRACT

A fuel injector includes a seat, a movable member cooperating with the seat, and an orifice plate. The orifice disc includes a member having first and second generally parallel surfaces, and an orifice extending through the member between first and second generally planar surfaces of the member. The orifice is defined by a wall that couples the first and second surfaces. The wall includes first and second wall portions. The first wall portion is spaced from the first surface and extends substantially perpendicular to the first and second generally planar surfaces and about the longitudinal axis to define a transition perimeter. The second wall portion couples the first wall portion to the first surface to define a inlet perimeter on the first surface. The inlet perimeter includes a plurality of curved surfaces connecting the inlet perimeter and the transition perimeter, each of the plurality of curved surfaces being separated by adjacent curved surfaces by a line connecting the inlet and transition perimeters in a helical orientation with respect to the orifice axis.

7 Claims, 4 Drawing Sheets

U.S. PATENT DOCUMENTS

| | | | | |
|---|---|---|---|---|
| 5,201,806 | A | | 4/1993 | Wood |
| 5,232,163 | A | * | 8/1993 | Grytz ..... 239/405 |
| 5,244,154 | A | | 9/1993 | Buchholz et al. |
| 5,335,864 | A | | 8/1994 | Romann et al. |
| 5,344,081 | A | | 9/1994 | Wakeman |
| 5,365,819 | A | | 11/1994 | Maida et al. |
| 5,449,114 | A | | 9/1995 | Wells et al. |
| 5,489,065 | A | | 2/1996 | Nally, Jr. |
| 5,516,047 | A | | 5/1996 | Kubach et al. |
| 5,553,397 | A | | 9/1996 | Schwitzky et al. |
| 5,636,796 | A | | 6/1997 | Oguma |
| 5,697,154 | A | | 12/1997 | Ogihara |
| 5,730,368 | A | | 3/1998 | Flik et al. |
| 5,746,376 | A | | 5/1998 | Romann et al. |
| 5,766,441 | A | | 6/1998 | Arndt et al. |
| 5,772,124 | A | | 6/1998 | Tamaki et al. |
| 5,785,254 | A | | 7/1998 | Zimmermann et al. |
| 5,816,093 | A | | 10/1998 | Takeuchi et al. |
| 5,862,991 | A | | 1/1999 | Willke et al. |
| 5,931,391 | A | | 8/1999 | Tani et al. |
| 6,009,787 | A | | 1/2000 | Hänggi |
| 6,039,271 | A | | 3/2000 | Reiter |
| 6,070,812 | A | | 6/2000 | Tani et al. |
| 6,089,476 | A | | 7/2000 | Sugimoto et al. |
| 6,102,299 | A | | 8/2000 | Pace et al. |
| 6,109,086 | A | | 8/2000 | Gambrel et al. |
| 6,131,826 | A | | 10/2000 | Teiwes |
| 6,170,763 | B1 | | 1/2001 | Fuchs et al. |
| 6,394,367 | B1 | | 5/2002 | Munezane et al. |
| 6,405,946 | B1 | | 6/2002 | Harata et al. |
| 6,899,290 | B1 | * | 5/2005 | Varble et al. ..... 239/533.12 |
| 2002/0063175 | A1 | | 5/2002 | Kitamura et al. |
| 2004/0056114 | A1 | | 3/2004 | Peterson, Jr. |
| 2004/0056115 | A1 | | 3/2004 | Peterson, Jr. |

FOREIGN PATENT DOCUMENTS

| | | |
|---|---|---|
| EP | 1 154 151 | 11/2001 |
| JP | 59-223121 | 12/1984 |
| JP | 60-137529 | 7/1985 |
| JP | 10-122096 | 12/1998 |
| JP | 2000-097129 | 9/2000 |
| WO | WO 00/52328 | 9/2000 |

* cited by examiner

FUEL INJECTOR INCLUDING AN ORIFICE DISC AND A METHOD OF FORMING AN OBLIQUE SPIRAL FUEL FLOW

FIELD OF INVENTION

This invention relates generally to electrically operated fuel injectors of the type that inject volatile liquid fuel into an automotive vehicle internal combustion engine, and in particular the invention relates to a novel thin disc orifice member for such a fuel injector.

BACKGROUND OF THE INVENTION

It is believed that contemporary fuel injectors must be designed to accommodate a particular engine. The ability to meet stringent tailpipe emission standards for mass-produced automotive vehicles is at least in part attributable to the ability to assure consistency in both shaping and aiming the injection spray or stream, e.g., toward intake valve(s) or into a combustion cylinder. Wall wetting should be avoided.

Because of the large number of different engine models that use multi-point fuel injectors, a large number of unique injectors are needed to provide the desired shaping and aiming of the injection spray or stream for each cylinder of an engine. To accommodate these demands, fuel injectors have heretofore been designed to produce straight streams, bent streams, split streams, and split/bent streams. In fuel injectors utilizing thin disc orifice members, such injection patterns can be created solely by the specific design of the thin disc orifice member. This capability offers the opportunity for meaningful manufacturing economies since other components of the fuel injector are not necessarily required to have a unique design for a particular application, i.e. many other components can be of common design.

SUMMARY OF THE INVENTION

The present invention provides a fuel injector for spray targeting fuel. The fuel injector includes a seat, a movable member cooperating with the seat, and an orifice plate. The seat includes a passage that extends along a longitudinal axis, and the movable member cooperates with the seat to permit and prevent a flow of fuel through the passage. The orifice disc includes a member having first and second generally parallel surfaces, and an orifice extending through the member between first and second generally planar surfaces of the member. The first surface generally confronts the seat, and the second surface faces opposite the first surface. The orifice is defined by a wall that couples the first and second surfaces. And the wall includes first and second portions. The first wall portion is spaced from the first surface and extends substantially perpendicular to the first and second generally planar surfaces. The second wall portion couples the first wall portion to the first surface to define a inlet perimeter on the first surface. The inlet perimeter includes a plurality of curved surfaces connecting the inlet perimeter and the transition perimeter. Each of the plurality of curved surfaces is separated by adjacent curved surfaces by a line connecting the inlet and transition perimeters in a helical orientation with respect to the orifice axis.

The present invention also provides a method of forming an orifice disc for a fuel injector. The orifice disc includes a member that has first and second generally parallel surfaces. The orifice is defined by a wall that couples the first and second surfaces, and the orifice extends along an orifice axis that is generally perpendicular to the first and second generally parallel surfaces. The method can be achieved by forming an orifice extending through the member between first and second generally planar surfaces of the member and deforming the orifice proximate the first surface; and deforming the orifice proximate the first surface into a plurality of segmented surfaces extending helically from the first surface to the orifice.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

DETAILED DESCRIPTION OF THE PREFERRED EMBODIMENT(S)

Figure 1A:
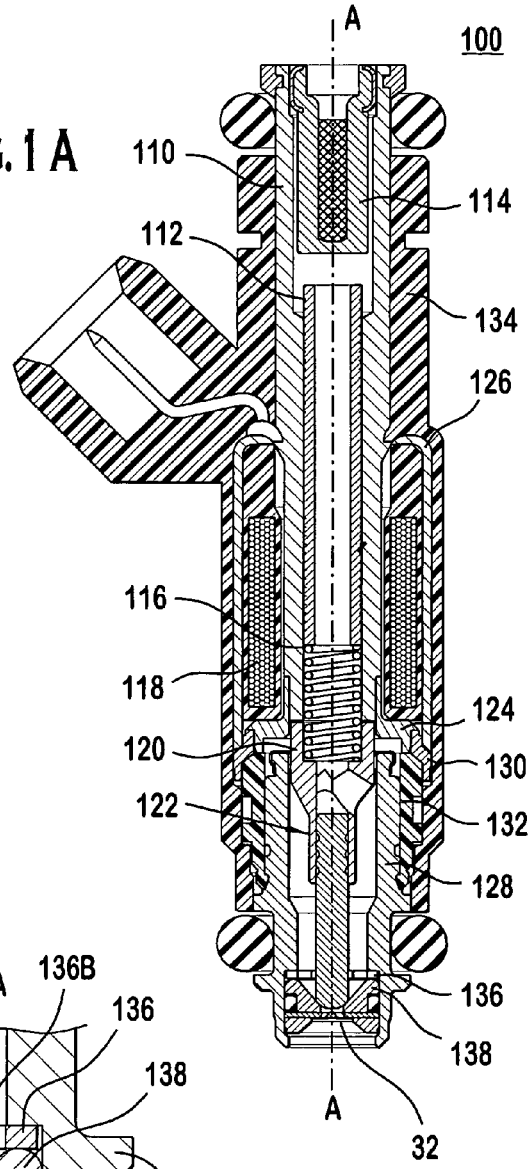
FIG. 1A is a cross-sectional view of a fuel injector according to a preferred embodiment of the present invention.

FIGS. 1–2 illustrate the preferred embodiments. In particular, a fuel injector 100 extends along a longitudinal axis A—A, as illustrated in FIG. 1A, and includes: a fuel inlet tube 110, an adjustment tube 112, a filter assembly 114, a coil assembly 118, a coil spring 116, an armature 120, a closure member assembly 122, a non-magnetic shell 124, a fuel injector overmold 135, a body 128, a body shell 130, a body shell overmold 132, a coil assembly housing 126, a guide member 136 for the closure member assembly 122, a seat 138, and an orifice disc 140. The construction of fuel injector 100 can be of a type similar to those disclosed in commonly assigned U.S. Pat. Nos. 4,854,024; 5,174,505; and 6,520,421, which are incorporated by reference herein in their entireties.

Figure 1B:
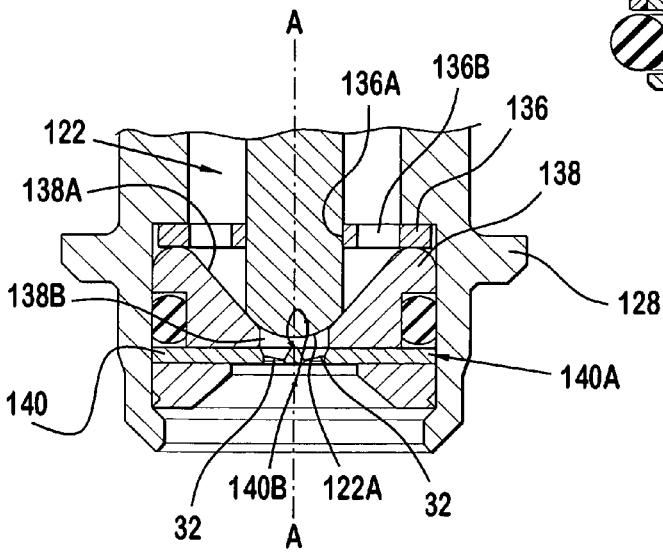
FIG. 1B is a cross-sectional view of the outlet end portion of the fuel injector of FIG. 1A.

FIG. 1B shows the outlet end of a body 128 of a solenoid operated fuel injector 100 having an orifice disc 140 embodying principles of the invention. The outlet end of fuel injector 100 is also similar those of the aforementioned patents including that of a stack. The stack includes a guide member 136 and a seat 138, which are disposed axially interiorly of orifice disc 140. The stack can be retained by a suitable technique such as, for example, a retaining lip with a retainer or by welding the disc 140 to the seat 138 and welding the seat 138 to the body 128.

Seat 138 can include a frustoconical seating surface 138*a* that leads from guide member 136 to a central passage 138*b* of the seat 138 that, in turn, leads to a central portion 140B of orifice disc 140. Guide member 136 includes a central guide opening 136A for guiding the axial reciprocation of a sealing end 122*a* of a closure member assembly 122 and several through-openings 136B distributed around opening 136A to provide for fuel to flow through sealing end 122*a* to the space around seat 138. FIG. 1B shows the hemispherical sealing end 122*a* of closure member assembly 122 seated on seat 138, thus preventing fuel flow through the fuel injector. When closure member assembly 122 is separated from the seat 138, fuel is permitted to pass thorough passage 138*b*, through orifices 32 extending through the orifice disc 140 such that fuel flows out of the fuel injector 100.

The orifice disc 140 can have a generally circular shape with a circular outer peripheral portion 140A that circumferentially bounds the central portion 140B that is located axially in the fuel injector. The central portion 140B of orifice disc 140 is imperforate except for the presence of one or more asymmetric orifices 32 via which fuel passes through orifice disc 140. Any number of asymmetric orifices 32 can be configured in a suitable array about the longitudinal axis A—A so that the orifice disc 140 can be used for its intended purpose in metering, atomizing, and targeting fuel spray of a fuel injector. The preferred embodiments include four such through-asymmetric orifices 32 (although only two are shown in the Figures) arranged about the longitudinal axis A—A through the orifice disc 140.

Figure 2A:
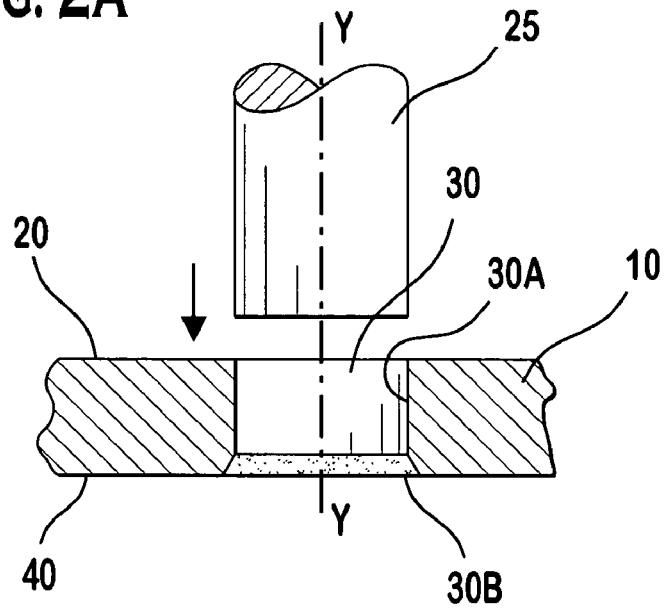
FIGS. 2A and 2B depict part of the process of forming the orifice disc of the preferred embodiments.
Figure 2B:
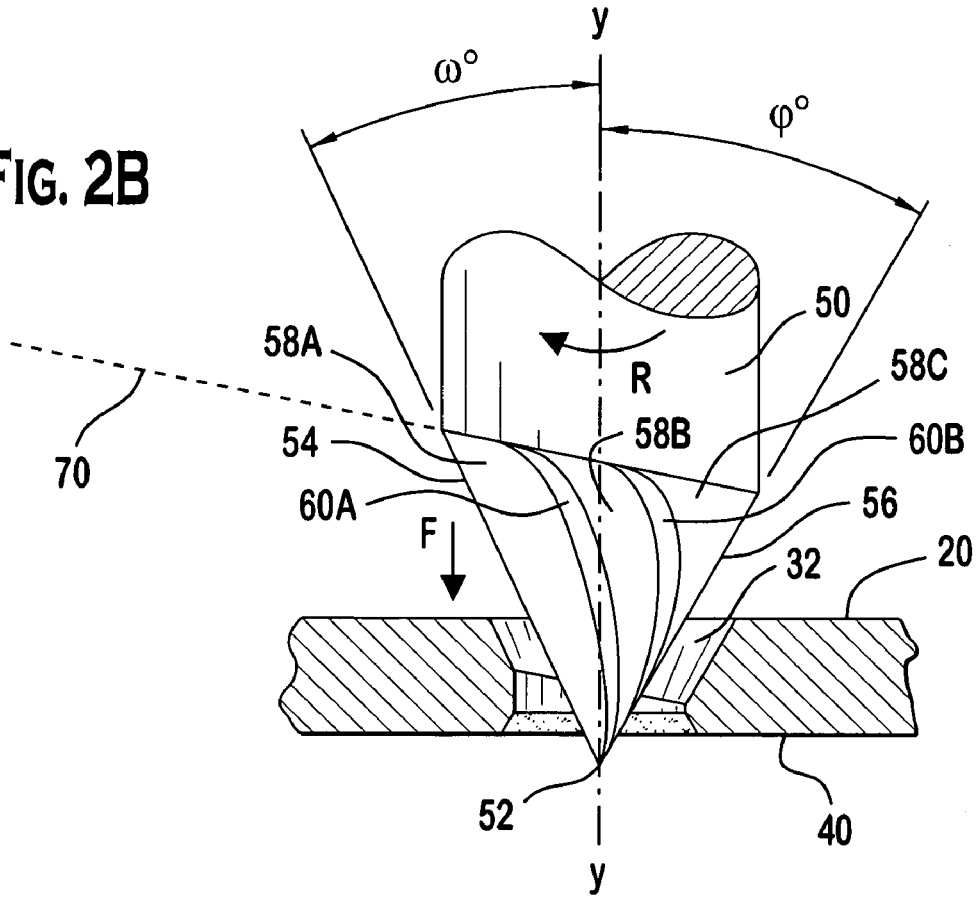

Referencing FIGS. 2A and 2B, the preferred embodiments of the orifice disc 140 can be formed as follows. Initially, a generally planar blank work piece 10 having a first surface 20 spaced at a distance from a second surface 40 without any orifices extending therethrough is provided. The blank 10 is penetrated by a suitable technique such as, for example, punching, coining, drilling or laser machining to form a pilot through opening or pilot orifice 30 that is symmetrical about and extending along an axis Y—Y of the tool 25 generally perpendicular to the planar surfaces 20 and 40 of the blank. Preferably, the symmetrical pilot through-opening 30 is formed by a cylindrical punch 25 that forms a perpendicular burnished wall section 30A between surface 20 and proximate surface 40 with a rough chamfer 30B formed by a breakout (i.e., a fracturing) of material by the cylindrical punch 25 as the cylindrical punch 25 penetrates through to the second surface 40.

The symmetrical through opening or orifice 30 is further penetrated by a suitable technique to form an asymmetrical through-opening or orifice 32. Thereafter, the work piece can be processed into an orifice disc 140 by a suitable material finishing technique such as, for example, stamping, grinding, deburring, skiving, or polishing the work piece into a desired configuration.

Figure 2C:
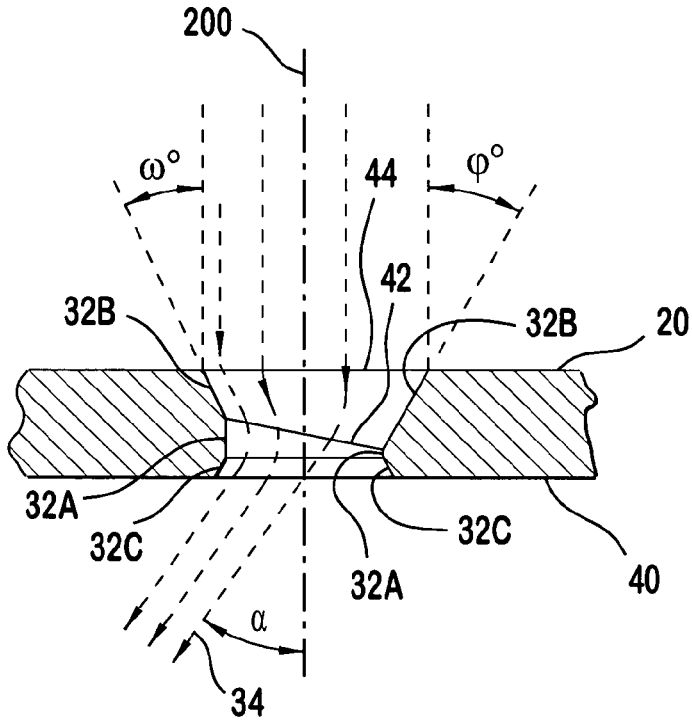
FIG. 2C depicts details of the orifice disc of FIG. 2B in a fragmentary cross-sectional view.
Figure 2D:
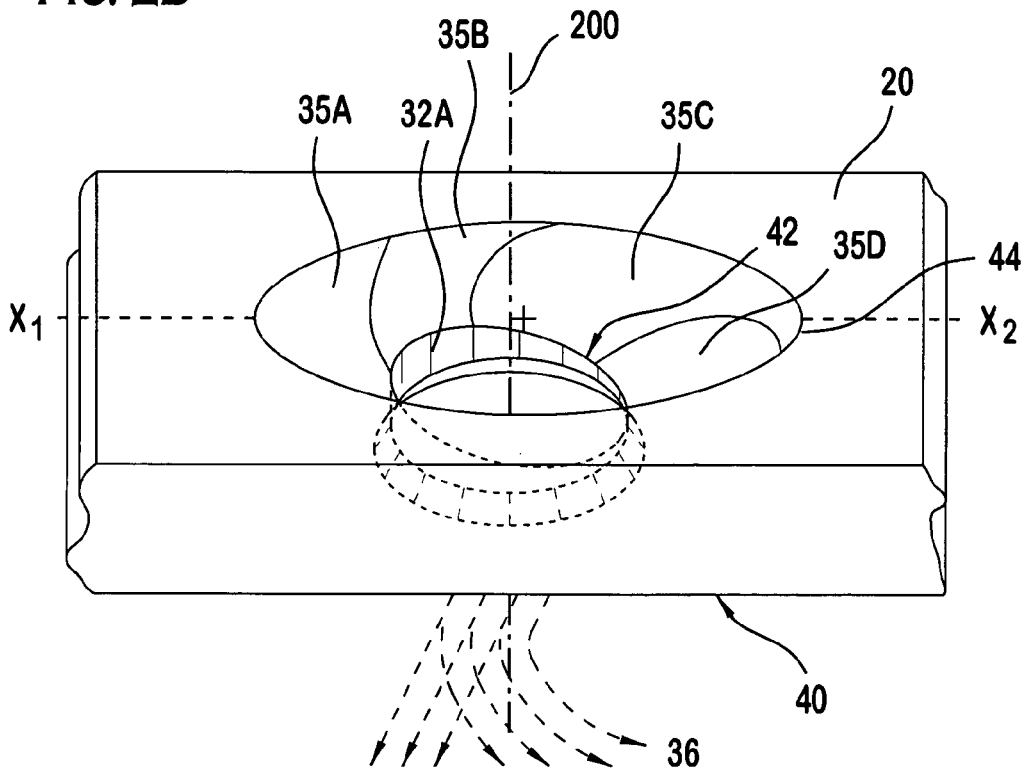
FIG. 2D depicts details of the orifice disc of FIG. 2B in a fragmentary perspective view.

In a preferred embodiment, the asymmetric orifice 32 is formed by a punch tool 50 having a conic surface defining an apex 52 with at least two leading edges disposed about the tool axis Y—Y such that the resulting cross-section of the punch tool 50 is asymmetric about the orifice axis 200 (FIGS. 2C, 2D). As shown in FIG. 2B, the conic surface has leading edge 54 and leading edge 56. The first leading edge 54 is oriented at a first lead angle $\omega°$ different from the second lead angle $\phi°$ of the second leading edge 56. In one of the preferred embodiments, the first lead angle $\omega°$ is approximately 25 degrees and the second lead angle $\phi°$ is approximately 30 degrees. Disposed between the first leading edge 54 and second leading edge 56 are a plurality of surface profiles contiguous to one another between the edges 54 and 56 at respective lead angles relative to the tool axis Y—Y. The lead angles for the conic surface about the tool axis Y—Y can be a range of angles in discrete steps between the first and second lead angles. Preferably, the lead angles for the conic surface about the tool axis Y—Y include continuously varying angles between the first and second lead angles.

Referring to FIG. 2C, the asymmetric orifice 32 is shown after the punching of the tool 50 through the work piece along the orifice axis 200. The orifice 32 has a wall coupling the first and second surfaces 20, 40 that includes a first wall portion 32A, second wall portion 32B, and third wall portion 32C. The first wall portion 32A is spaced from the first surface 20 and extends substantially perpendicular to the first and second generally planar surfaces 20, 40 and about the orifice axis 200 to define a transition perimeter 42. The second wall portion 32B couples the first wall portion 32A to the first surface 20 to define an elliptical inlet perimeter 44 on the first surface 20.

Figure 2E:
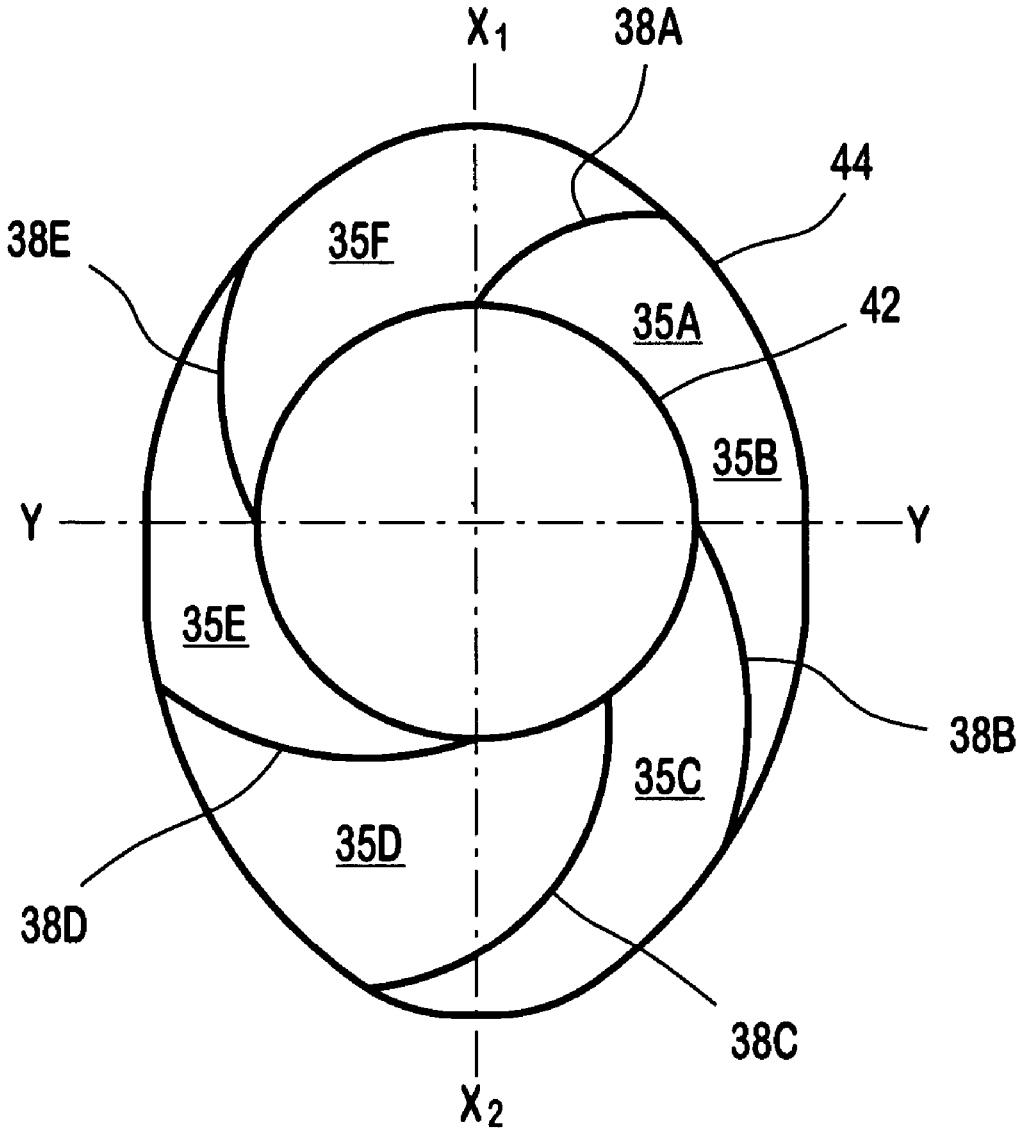
FIG. 2E depicts a top plan view of the orifice formed by the tool during the punching process.

Furthermore, the working surface of the tool 50 can be provided with a plurality of raised helical surfaces 58A, 58B, 58C . . . . Upon impact with the cylindrical pilot orifice 30, the helical surfaces 58A–58C can form corresponding segmented surfaces 35A–35F that extend helically towards a transition perimeter 42 so that the segmented surfaces 35A–35F define an asymmetric orifice 32. As shown in FIG. 2E, the segmented surfaces 35A–35F can be defined by a plurality of helically arrayed lines 38A–38E and so on connecting the preferably elliptical inlet perimeter 44 and the preferably cylindrical inlet transition section 42. Due to the convergent surface 35A–35F arrayed in such pattern about the orifice axis 200, fuel flowing through the orifice 32 tends to be induced with a rotation about the orifice axis 200.

The benefits of the asymmetrical geometry of the orifice 32 are believed to be many. The orifice 32 can be formed by two tools moving in a direction perpendicular to the work piece to generate an orifice that emulates an angled orifice without requiring a tool to be oriented oblique to the perpendicular direction. Furthermore, the asymmetrical geometry of the orifice 32 tends to angle the fuel flow 34 from and about the axis 200 to provide a spiraling fuel flow 36, which feature is believed to permit more of the fuel to be atomized. Moreover, the spiral segmented surfaces 35A–35F formed by the tool 50 are believed to induce the spiral fuel flow path 36 such that increased fuel atomization can be achieved.

While the present invention has been disclosed with reference to certain preferred embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

What I claim is:

1. A fuel injector for metering, atomizing and spray targeting of fuel, the fuel injector comprising:

a seat including a passage extending along a longitudinal axis;

a movable member cooperating with the seat to permit and prevent a flow of fuel through the passage; and an orifice disc including:

a member including first and second generally parallel surfaces, the first surface generally confronting the seat, and the second surface facing opposite the first surface; and an orifice extending through the member between first and second generally planar surfaces of the member along an orifice axis and being defined by a wall coupling the first and second surfaces, the wall including:

a first wall portion spaced from the first surface, the first wall portion extending substantially perpendicular to the first and second generally planar surfaces and about the longitudinal axis to define a transition perimeter; and a second wall portion coupling the first wall portion to the first surface to define a inlet perimeter on the first surface, the inlet perimeter including:

a plurality of curved surfaces connecting the inlet perimeter and the transition perimeter, each of the plurality of curved surfaces being separated by adjacent curved surfaces by a line connecting the inlet and transition perimeters in a helical orientation with respect to the orifice axis.

2. The fuel injector according to claim 1, wherein the inlet perimeter on the first surface includes a convergent surface extending towards and about the longitudinal axis, the convergent surface intersects the transition perimeter to define a generally circular aperture at the intersection between the surface and the first wall portion.

3. The fuel injector according to claim 2, wherein the transition perimeter lies on an oblique plane with respect to the orifice axis.

4. The fuel injector according to claim 3, wherein the wall comprises a third portion coupling the first portion to the second surface.

5. The fuel injector according to claim 4, wherein the third portion of the wall extends at a second oblique angle with respect to the second surface, and the second oblique angle being generally constant about the orifice axis.

6. The fuel injector according to claim 5, wherein the third portion of the wall comprises an irregular surface.

7. The fuel injector according to claim 6, further comprising a outlet perimeter being defined by a juncture of the second surface and the third portion of the wall, the outlet perimeter being irregular and asymmetrical about the orifice axis.

* * * * *